US005495085A

United States Patent [19]

Yorita et al.

[11] Patent Number: 5,495,085

[45] Date of Patent: Feb. 27, 1996

[54] VACUUM INTERRUPTER

[75] Inventors: Mitsumasa Yorita, Marugame; Hideaki Toya, Amagasaki; Hiroshi Hasegawa, Marugame; Kenichi Koyama, Amagasaki, all of Japan

[73] Assignee: Mitsubishi Denki Kabushiki Kaisha, Tokyo, Japan

[21] Appl. No.: 145,743

[22] Filed: Nov. 4, 1993

[30] Foreign Application Priority Data

| | | | |
|---|---|---|---|
| Nov. 10, 1992 | [JP] | Japan | 4-326090 |
| Nov. 10, 1992 | [JP] | Japan | 4-326092 |
| Nov. 19, 1992 | [JP] | Japan | 4-335146 |
| Nov. 19, 1992 | [JP] | Japan | 4-335147 |
| Jul. 5, 1993 | [JP] | Japan | 5-165429 |
| Jul. 5, 1993 | [JP] | Japan | 5-165430 |
| Jul. 22, 1993 | [JP] | Japan | 5-181300 |
| Jul. 22, 1993 | [JP] | Japan | 5-181301 |
| Oct. 29, 1993 | [JP] | Japan | 5-271959 |

[51] Int. Cl.[6] ..... H01H 33/66

[52] U.S. Cl. ..... 218/123; 218/127; 218/129; 200/147 R; 200/144 B

[58] Field of Search ..... 200/144 B, 147 A, 200/147 R; 218/22–42, 123–129

[56] References Cited

U.S. PATENT DOCUMENTS

| | | | |
|---|---|---|---|
| 4,336,430 | 6/1982 | Kurosawa et al. | 200/144 B |
| 4,430,536 | 2/1984 | Kurosawa et al. | 200/144 B |
| 4,473,731 | 9/1984 | Yorita | 200/144 B |
| 4,584,445 | 4/1986 | Kashiwagi et al. | 200/144 B |
| 4,588,879 | 5/1986 | Noda et al. | 200/144 B |
| 4,667,070 | 5/1987 | Zuckler | 200/144 B |
| 4,935,588 | 6/1990 | Hess et al. | 200/144 B |
| 5,055,639 | 10/1991 | Schels et al. | 200/144 B |

FOREIGN PATENT DOCUMENTS

| | | | |
|---|---|---|---|
| 0113962 | 7/1984 | European Pat. Off. | H01H 33/66 |
| 0192251 | 8/1986 | European Pat. Off. | H01H 33/66 |
| 0199593 | 10/1986 | European Pat. Off. | H01H 33/66 |
| 3510981 | 10/1985 | Germany | H01H 33/66 |
| 3610245 | 10/1987 | Germany | H01H 33/66 |
| 50-52562 | 5/1975 | Japan | H01H 33/66 |
| 57-76713 | 5/1982 | Japan | H01H 33/66 |
| 61-195528 | 8/1986 | Japan | H01H 33/66 |
| 2111309 | 6/1983 | United Kingdom | H01H 33/66 |
| 2231723 | 11/1990 | United Kingdom | H01H 33/66 |

OTHER PUBLICATIONS

*Patent Abstracts of Japan,* vol. 16, No. 91, E–1174, Mar. 5, 1992.

*Patent Abstracts of Japan,* vol. 17, No. 608, E–1457, Nov. 9, 1993.

*Primary Examiner*—J. R. Scott

*Attorney, Agent, or Firm*—Burns, Doane, Swecker & Mathis

[57] ABSTRACT

In a vacuum interrupter comprising a disc-shaped stationary electrode and a disc-shaped movable electrode arranged in an evacuated envelope in opposed relationship, a slot or a salient part is formed on the surface of both the electrodes and thereby a path of an arc current in disconnection operation of both the electrodes is formed along the circumference of the disc-shaped electrode. The shape and position of the slot is selected so that the arc current flows uniformly along the entire circumference of both the electrodes.

3 Claims, 11 Drawing Sheets

VACUUM INTERRUPTER

FIELD OF THE INVENTION AND RELATED ART STATEMENT

1. Field of the Invention

The present invention relates generally to a vacuum interrupter which is used in a vacuum circuit breaker or the like, and more particularly to a vacuum interrupter having an electrode-structure which generates a magnetic field in the direction parallel to an electric arc generated after disconnection of the vacuum interrupter.

2. Description of the Related Art

In a vacuum interrupter for interrupting a heavy-current in an evacuated envelope, diffusion of an arc generated after disconnection operation of the vacuum interrupter have been studied in order to improve interruption characteristic thereof. The diffusion of the arc is performed by a magnetic field which is generated by an arc current flowing after the disconnection operation. A conventional vacuum interrupter comprising such an arc diffusion means is elucidated hereafter with reference to FIGS. 10, 11 and 12.

FIG. 10 is a cross-section of a side view showing schematic structure of the conventional vacuum interrupter. Referring to FIG. 10, an evacuated envelope 4 is composed of a cylindrical insulating container 1 and end plates 2 and 3 for sealing both ends of the insulating container 1. A disc-shaped stationary electrode assembly 6 connected to a stationary electrode rod 5 and a discshaped movable electrode assembly 7 connected to a movable electrode rod 8 are arranged in opposed relationship in the evacuated envelope 4. The movable electrode assembly 7 is constructed so as to connect or disconnect with respect to the stationary electrode assembly 6 by an operation mechanism (not shown) connected mechanically to the movable electrode rod 8. A bellows 10 is disposed between the end plate 3 and the movable electrode rod 8, and thereby air-tightness of the evacuated envelope 4 is maintained and the movable electrode rod 8 is permitted to move in the axial direction (upward or downward in FIG. 10). Moreover, a shield 9 is arranged in a manner of surrounding the stationary electrode assembly 6 and the movable electrode assembly 7 in the evacuated envelope 4.

In a conventional vacuum circuit breaker having the vacuum interrupter constructed as mentioned above, when a disconnecting instruction is inputted to the vacuum circuit breaker, the movable electrode assembly 7 is disconnected from the stationary electrode assembly 6 by activation of the operation mechanism. At the instant, an arc A is generated between the stationary electrode assembly 6 and tile movable electrode assembly 7, and an arc current flows across the stationary electrode assembly 6 and the movable electrode assembly 7. A magnetic field in the axial direction is generated between the stationary electrode assembly 6 and the movable electrode assembly 7 by controlling a direction of the arc current flowing across the stationary electrode assembly 6 and the movable electrode assembly 7. The magnetic field in the axial direction serves to diffuse a plasma arc produced between both the electrode assemblies onto entire surfaces of the stationary electrode assembly 6 and the movable electrode assembly 7 which are arranged in opposed relationship. An are voltage across the stationary electrode assembly 6 and the movable electrode assembly 7 is decreased by diffusing the plasma arc during the disconnection operation, and a temperature rise in both the electrode assemblies is significantly suppressed.

An example of the conventional vacuum interrupter having the electrode-structure for generating the magnetic field is shown in the U.S. Pat. No.4,473,731.

FIG. 11 is an exploded perspective assembly view of a movable electrode assembly 7 in the vacuum interrupter of the U.S. Pat. No. 4,473,731, and FIG. 12 is a plan view of the movable electrode assembly 7 shown in FIG. 11. Referring to FIG. 11, a movable electrode 21 is mounted on the top of a movable electrode rod 8 through a short circuit member 22, and is supported at the central part by a support member 23 which is made of high resistance material and fixed on the movable electrode rod 8. Four arms 21*a* are formed on the peripheral portion of the movable electrode 21 along the circumference thereof. On the other hand, four arms 22*a* extending in radial directions are formed on the short circuit member 22. The ends of the arms 22*a* of the short circuit member 22 contact the respective arms 21*a* of the movable electrode 21, and the movable electrode 21 is electrically connected to the short circuit member 22.

The movable electrode assembly 7 comprising the movable electrode 21, the movable electrode rod 8, the short circuit member 22 and the support member 23 shown in FIG. 11 is arranged in the evacuated envelope 4 in opposed relationship to the stationary electrode assembly 6 as shown in FIG. 10.

Referring to FIG. 12, current paths of the arc current are illustrated by arrows. The are current flows from the central part P of the movable electrode 21 to the connection parts of the arms 21*a* in the radial direction as shown by arrows X, and passes through the arms 21*a* along the circumference of the movable electrode 21 as shown by arrows Y. Subsequently, The arc current flows to the movable electrode rod 8 through the arms 22*a* of the short circuit member 22 in the radial directions as shown by arrows Z. Consequently, four fan-shaped current paths are formed as shown in the plan view of FIG. 12, and magnetic fields in the axial direction are generated in these fan-shaped regions by the known right-handed screw rule. The plasma arc produced between the stationary electrode assembly 6 and the movable electrode assembly 7 is diffused by the magnetic field. The intensity of the magnetic field in the fan-shaped region is larger than that in the region between neighboring two fan-shaped regions. Therefore, the intensity of the magnetic field is not uniform between the stationary electrode assembly 6 and the movable electrode assembly 7, and the plasma arc is not effectively diffused owing to the lack of uniformity of the magnetic field.

OBJECT AND SUMMARY OF THE INVENTION

An object of the present invention is to provide a vacuum interrupter in which a uniform magnetic field is generated between a stationary electrode and a movable electrode by guiding an arc current along full circumference of the stationary electrode and the movable electrode.

The vacuum interrupter in accordance with the present invention comprises:

a first electrode assembly and a second electrode assembly respectively having substantially the same structure arranged in an evacuated envelope in mutually opposed relationship by respective electrode rods in a manner to connect or disconnect with each other; each electrode assembly comprising;

a connecting conductor having a holding part electrically connected to the electrode rod and an arm part extended from the holding part in the radial direction, a coil electrode having a ring-shaped coil part with a cut-part cut out a part of the circumference and electrically connected to the arm part at an end adjacent to the cut-part of the ring-shaped coil part, and a disc-shaped main electrode mounted on a surface of the coil electrode in a manner of facing the other electrode assembly, having at least one slot formed in a radial direction directed to the cut-part of the coil electrode and passing through the central part of a surface of the disc-shaped main electrode opposing to the other electrode assembly, the cut-part of the coil electrode of the first electrode assembly being opposed to the cut-part of the coil electrode of the second electrode assembly, and a position connecting between the coil part and the arm part in the first electrode assembly being arranged in point symmetry with respect to the position connecting between the coil part and the arm part in the second electrode assembly.

The vacuum interrupter in accordance with the present invention has the following technical advantage as a result of the above-mentioned configuration:

in the vacuum interrupter of the embodiments shown in FIGS. 1–9, a current at generation of an arc is made to flow along a substantially arc-shaped path at each electrode by forming slots on the mutually opposed surfaces of the main electrodes and coil electrodes. Consequently, a uniform magnetic field of the axial direction is generated between both the electrodes arranged in mutually opposed relationship, by a rather simple configuration, and thereby a plasma arc generated between both the electrodes is effectively diffused and distinguished, and the vacuum interrupter having superior disconnection characteristic can be provided.

DESCRIPTION OF THE PREFERRED EMBODIMENT

[First embodiment]

Hereafter, a first embodiment of the vacuum interrupter corresponding to the constitution of claim 1 is elucidated with reference to drawings.

Figure 1:
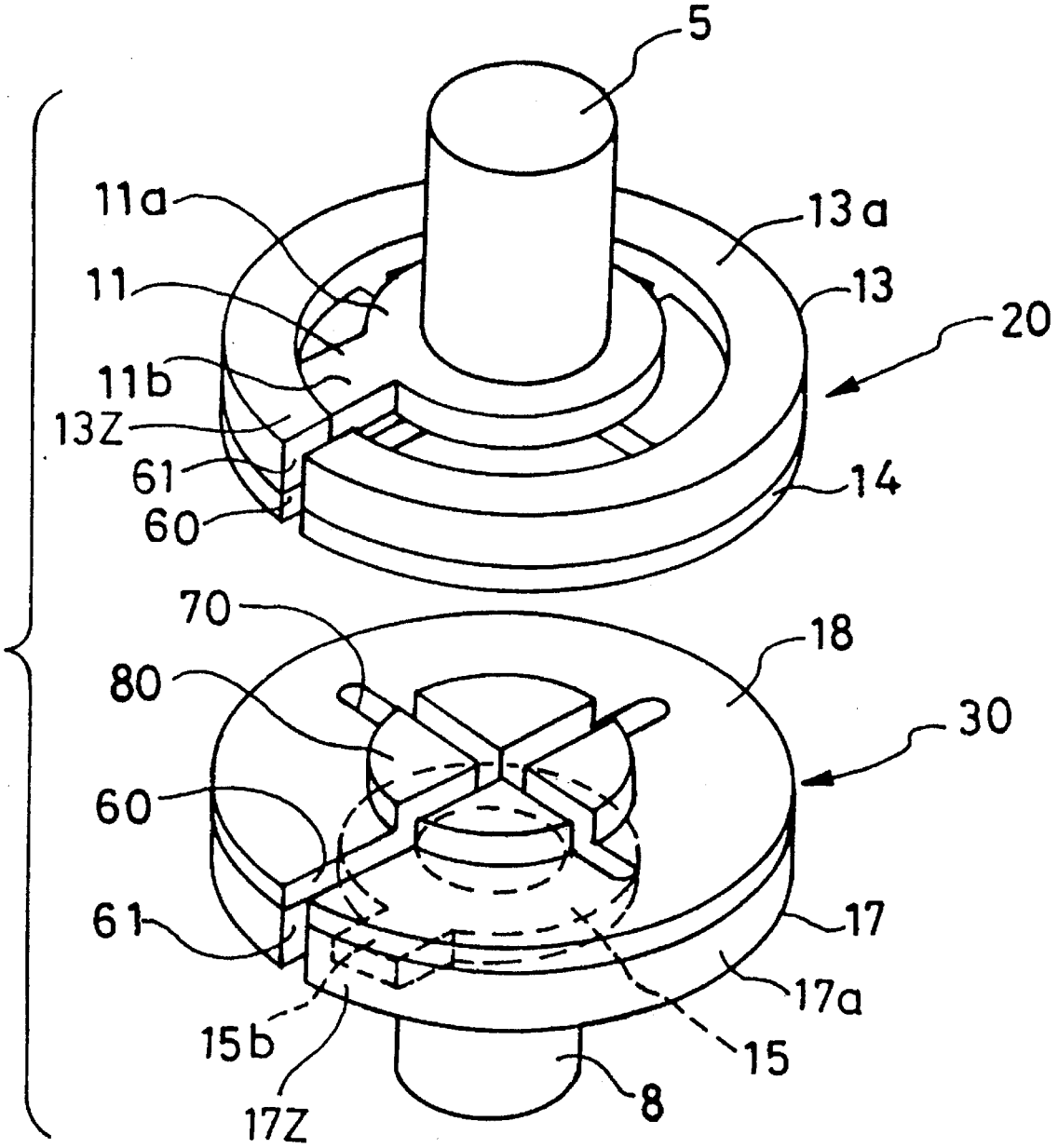
FIG. 1 is a perspective view of a stationary electrode assembly and a movable electrode assembly of a vacuum interrupter in a first embodiment in accordance with the present invention.
Figure 2:
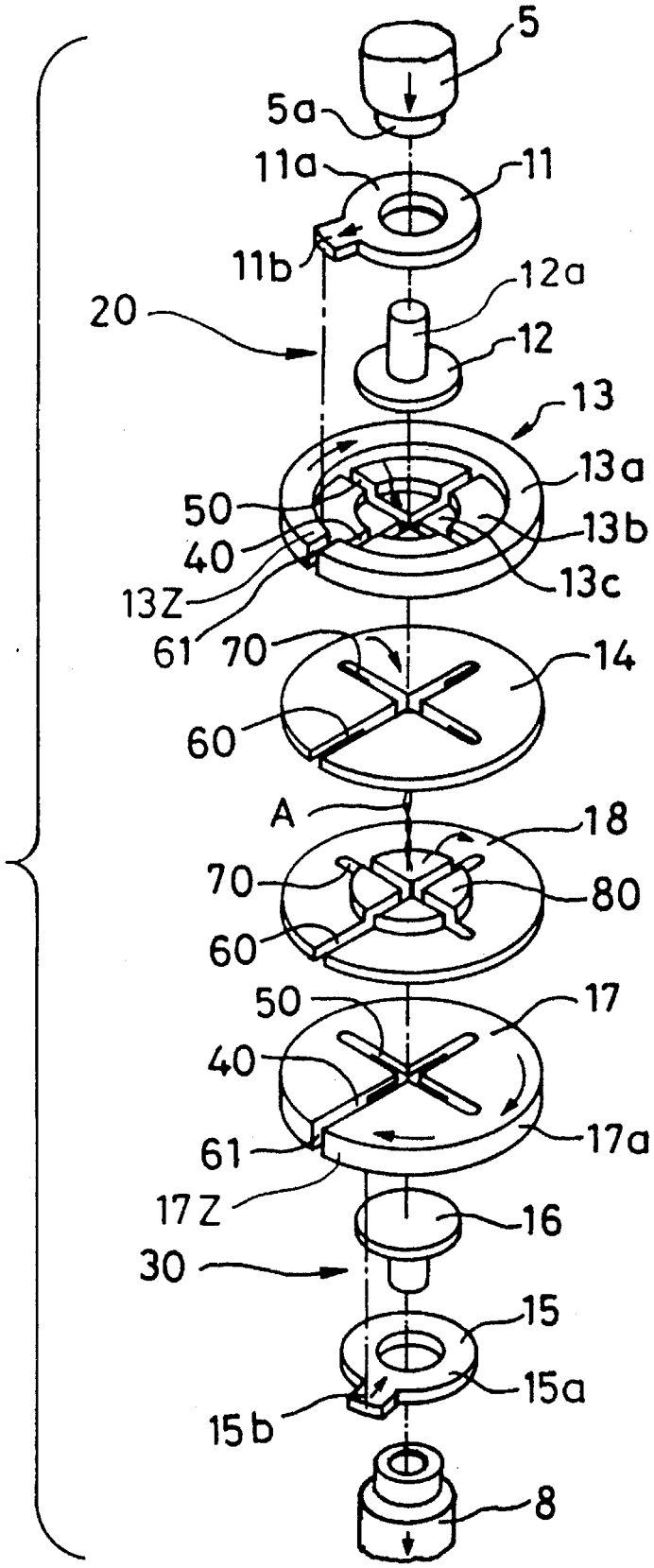
FIG. 2 is an exploded perspective assembly view of the stationary electrode assembly and the movable electrode assembly in FIG. 1.

FIG. 1 is a perspective view illustrating electrode assemblies in the vacuum interrupter of the first embodiment, and FIG. 2 is an exploded perspective assembly view of the electrode assemblies in FIG. 1.

The electrode assemblies of the vacuum interrupter shown in FIG. 1 are arranged in an evacuated envelope and are structured so as to connect or disconnect with each other by an operation mechanism (not shown). The electrode assemblies shown in FIG. 1 comprise a stationary electrode assembly 20 fixed on the evacuated envelope through an insulating member and a movable electrode assembly 30 which moves upward or downward by activation of the operation mechanism (not shown) and connects or disconnects with the stationary electrode assembly 20. The stationary electrode assembly 20 is substantially identical with the movable electrode assembly 30 in structure, and one of them is inverted and is arranged in opposed relationship to the other. Therefore configuration of only the stationary electrode assembly 20 is elucidated in detail. As shown in the exploded perspective assembly view of FIG. 2, the stationary electrode assembly 20 comprises a stationary electrode rod 5, a stationary connection conductor 11, a support member 12, a stationary coil electrode 13 and a stationary main electrode 14; and the movable electrode assembly 30 comprises a movable electrode rod 8, a movable connection conductor 15, a support member 16, a movable coil electrode 17 and a movable main electrode 18.

As shown in FIG. 2, the stationary connection conductor 11 comprises a ring-shaped holding part **11*a* which is put on a boss 5*a* of the stationary electrode rod 5 and an arm part 11*b* extended outward in a radial direction. A gap 61 (cut-part) is formed by cutting out a part of the circumference of a ring-shaped coil part 13*a* placed on the peripheral portion of the stationary coil electrode 13. An end of the arm part 11*b* is electrically connected to the coil part 13*a* at the inside wall of a connecting part 13*z* in the vicinity of the gap 61. A circular pit 13*b* is formed inward from the coil part 13*a* of the stationary coil electrode 13, and a thickness of the circular pit 13*b* in the axial direction is thinner than that of the coil part 13*a* in the axial direction. A straight slot 40 is formed on the circular pit 13*b* in a manner of passing through the center of the circular pit 3*b* and communicating with the gap 61 of the coil part 13*a*. The length of the slot 40 is equal to the inner diameter of the coil part 13*a* or shorter than that. Moreover, another slot 50 intersects perpendicularly with the slot 40 at the center of the circular pit 13*b* and the length of the slot 50 is equal to the inner diameter of the coil part 13*a*** or shorter than that.

As shown in FIG. 2, the support member 12 supports the stationary coil electrode 13 by contacting with a hole **13*c* formed in the circular pit 13*b* of the stationary coil electrode 13. The support member 12 is made of high-resistance material such as stainless steel. A shaft 12*a* of the support member 12 is inserted in a hole of the boss 5***a* of the stationary electrode rod 5.

Slots 60 and 70 having the same shape as the slots 40 and 50 of the stationary coil electrode 13 are formed on the disc-shaped stationary main electrode 14 which is mounted on the surface of the stationary coil electrode 13 facing to the movable electrode assembly 30. The stationary main electrode 14 is fixed on the stationary coil electrode 13 in a manner that the slots 40 and 50 of The stationary coil electrode 13 overlap the slots 60 and 70 of the stationary main electrode 14, respectively.

As shown in FIG. 2, the stationary main electrode 14 and the movable main electrode 18 are provided with salient contacts 80 on the respective central surfaces, and an electric arc is produced on the salient contacts 80 between both the main electrodes. The arm part 11*b* is connected to the coil part 13*a* at the connecting part 13*z*, and in a similar manner, an arm part 15*b* of a movable connection conductor 15 in the movable electrode assembly 30 is electrically connected to a coil part 17*a* of the movable electrode assembly 30 at a connecting part 17*z*. The connecting part 13*z* and the connecting part 17*z* are arranged in the vicinity of opposed sides of a plane passing through both the gaps 61 and the centers of the coil parts 13*a* and 17*a*.

The stationary main electrode 14, the movable main electrode 18 and the salient contacts 80 are made of the following various materials corresponding to a capacity and intended purpose of the vacuum interrupter:

(1) Contact material of a type of Cu-Cr or Cu-Co in a large capacity vacuum interrupter, (2) Contact material of a type of Cu-W or Cu-Cr (50 wt % or more of content) in a high breakdown voltage vacuum interrupter, (3) Contact material containing low melting point material (Bi, Sb, Pb or Te) in the contact material of a type of Cu-Cr or Cu-Co in the case that welding of the contacts must be particularly prevented, (4) Contact material containing low melting point material (Bi, Sb, Pb, Te of 20 wt % and below of content) in the base material of a type of Cu-Cr, or contact material of a type of AgWC (5 wt % and below of Co, Ni or Fe is contained as an addition).

Subsequently, a current flow in generation of an electric arc between both the electrode assemblies in the first embodiment is elucidated with reference to FIG. 2. As shown in FIG. 2, when the electric arc A is generated between the stationary main electrode 14 and the movable main electrode 18, the current flows from the stationary electrode rod 5 to the coil part 13*a* via the stationary connection conductor 11, and reaches an arc generation point. In the movable electrode assembly 30, the current flows from the arc generation point to the radial direction in the movable main electrode 18 and passes the coil part 17*a*. And finally, the current flows from the end part of the coil part 17*a* to the movable connection conductor 15 and reaches the movable electrode rod 8.

As mentioned above, since the current at generation of the arc passes the coil parts 13*a* and 17*a* arranged on the respective circumferential parts of the coil electrodes 13 and 17, the flowing directions of the current are identical with each other on both the coil parts 13*a* and 17*a*, and their paths are substantially circular. Consequently, a magnetic field in the axial direction is generated between the main electrodes in generation of the arc.

Figure 3:
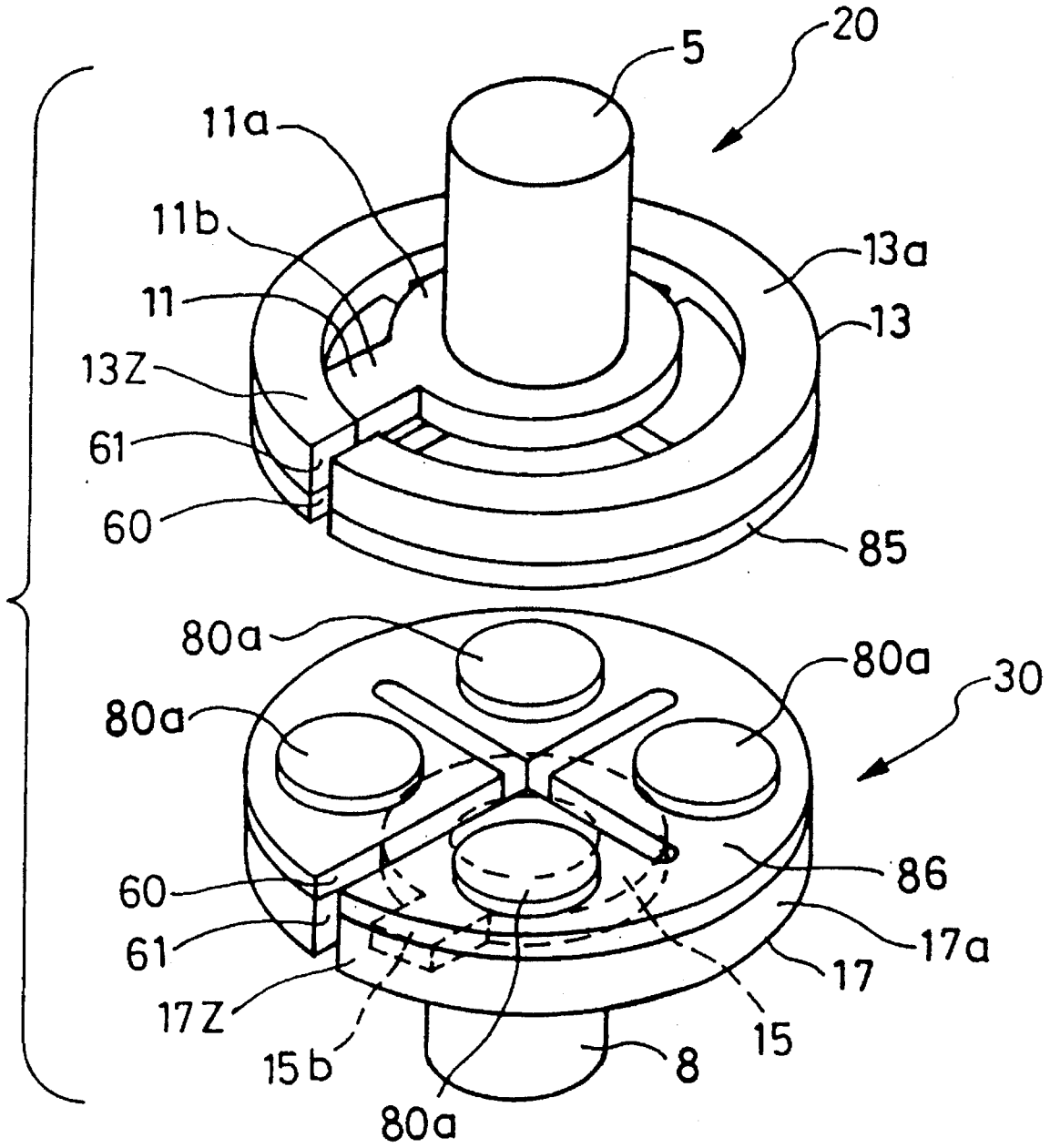
FIG. 3 is a perspective view of an example of the electrode assemblies of the vacuum interrupter in FIG. 1.
Figure 4:
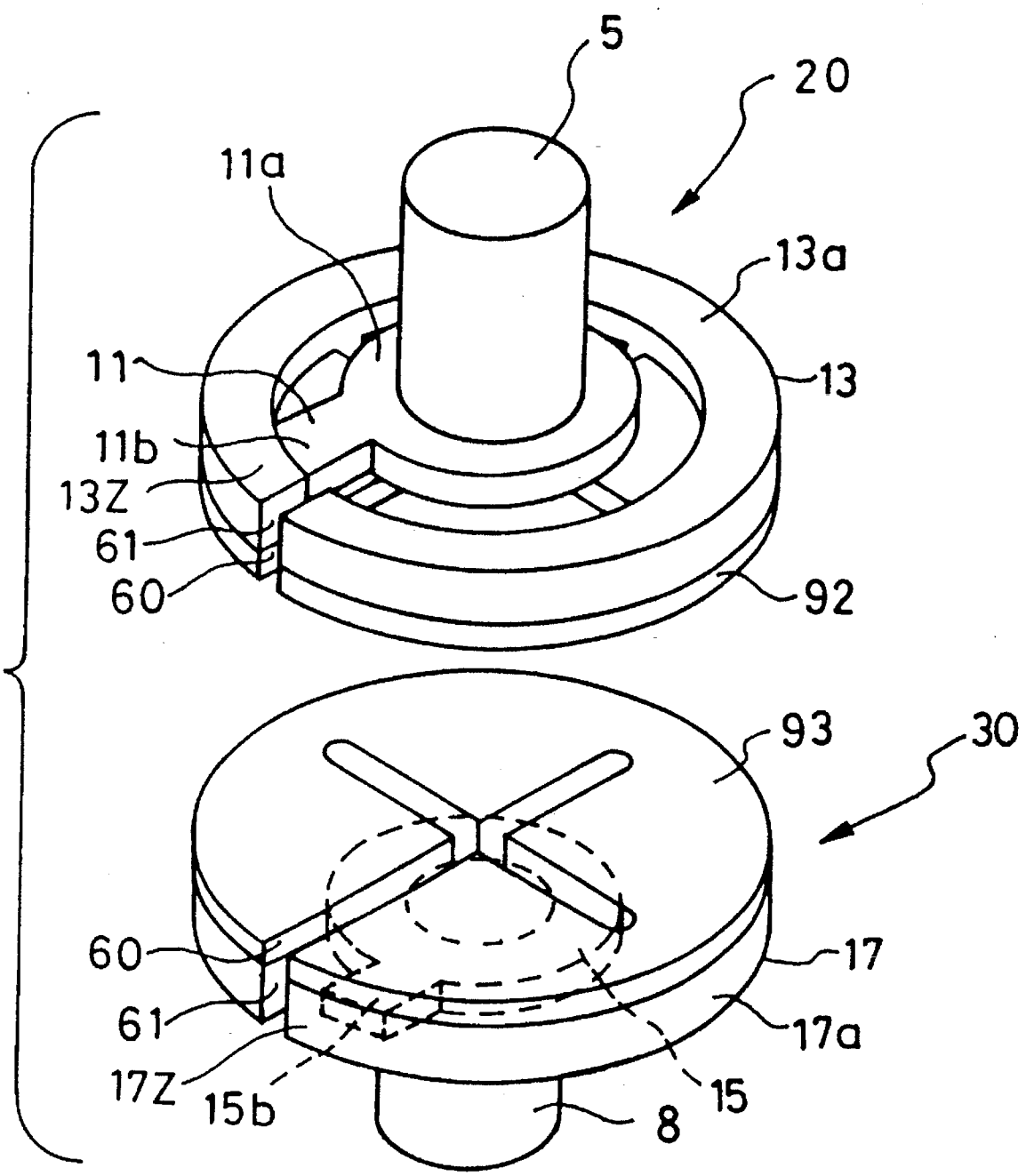
FIG. 4 is a perspective view of another example of the electrode assemblies of the vacuum interrupter in FIG. 1.

FIGS. 3 and 4 are perspective views of examples of the electrodes assemblies in the first embodiment. In FIG. 3, plural salient contacts 80*a* are formed on the surface of the stationary main electrode 85 and a hidden surface of the movable main electrode 86 of the respective electrode assemblies which are opposed with each other, and thereby positions generating the arc are decided between both the electrodes. The electrode assemblies shown in FIG. 4 comprise a disc-shaped stationary main electrode 92 and a disc-shaped movable main electrode 93, and thereby the electrode structure is simplified.

Figure 5:
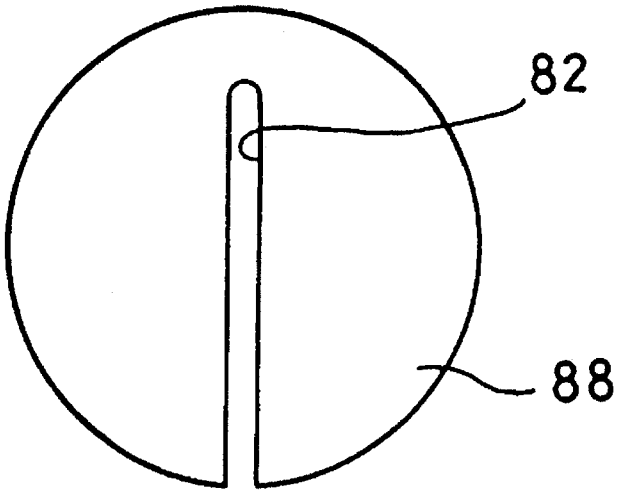
FIG. 5 is a plan view of an example of a main electrode in the electrode assemblies in FIG. 1.
Figure 6:
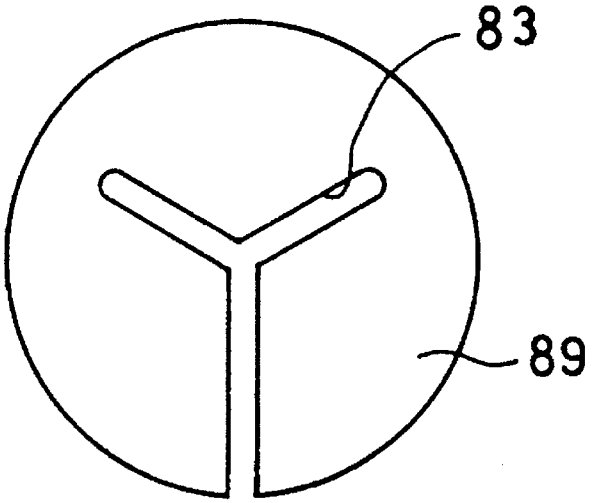
FIG. 6 is a plan view of another example of the main electrode in the electrode assemblies in FIG. 1.
Figure 7:
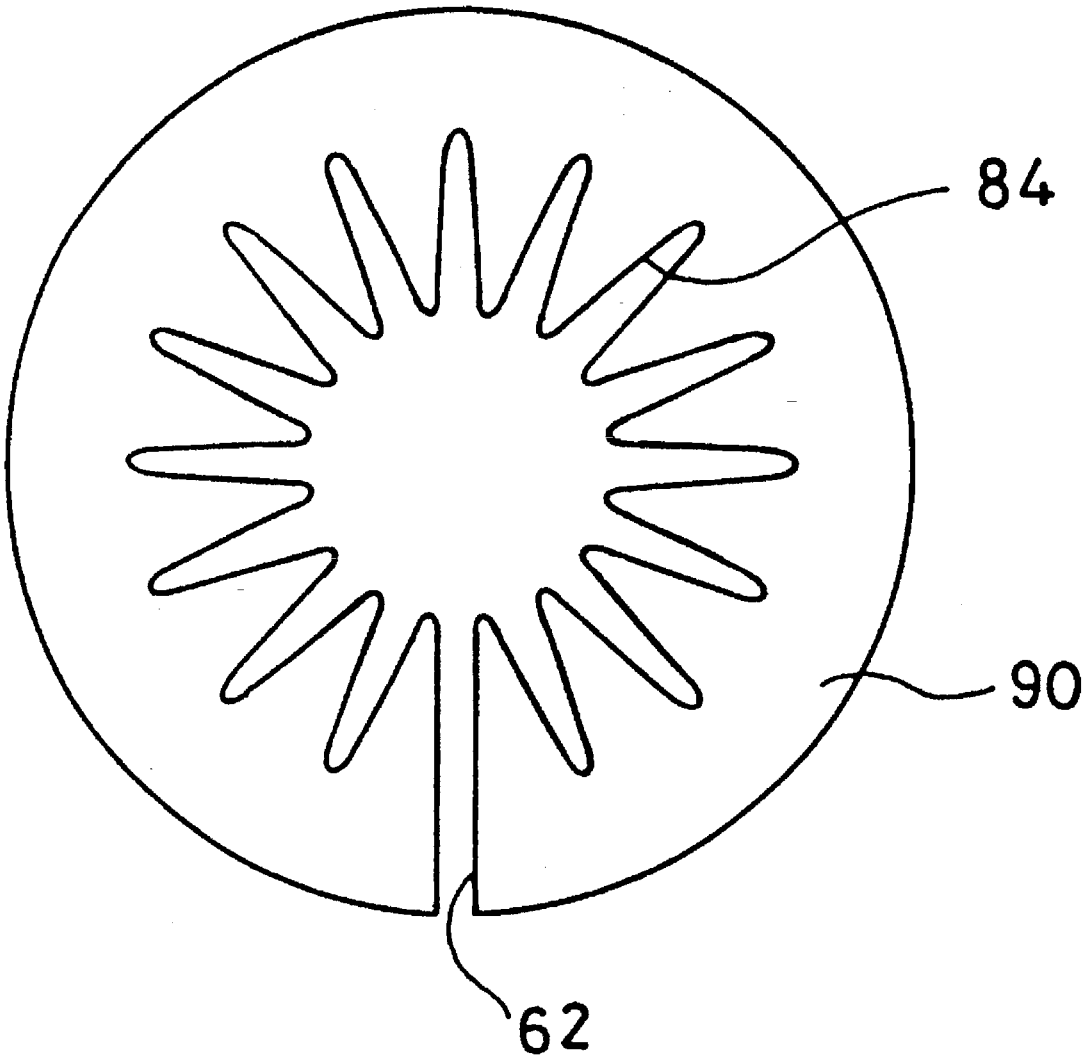
FIG. 7 is a plan view of further example of the main electrode in the electrode assemblies in FIG. 1.

In the above-mentioned first embodiment, though the cross-shaped slots are formed on both the electrode assemblies, the shape of the slots is not limited to the cross in the present invention. Slots shown in FIGS. 5, 6 and 7 may be formed on the electrode assemblies to realize the same effect as the above-mentioned embodiment. FIGS. 5, 6 and 7 are plan views of the shapes of the slots which are formed on the respective main electrodes and coil electrodes, and only the respective main electrodes in both the electrode assemblies are shown in these drawings. In FIG. 5, a straight line-shaped slot 82 is formed on the main electrode 88. In FIG. 6, a Y-shaped slot 83 is formed on the main electrode 89. In FIG. 7, a star-shaped opening is formed on the central part of the main electrode 90. The opening 84 is communicated to the outer circumference of the main electrode 90 through a slot 62 formed in the radial direction of the main electrode 90.

By the above-mentioned configuration of the main electrodes and the coil electrodes, when the electric arc is generated, the current flowing both the main electrodes passes on the substantially circular paths. Consequently, the magnetic field in the axial direction is generated between both the electrodes of the vacuum interrupter having the above-mentioned electrode assemblies, and thereby the plasma arc generated between both the electrodes is efficiently diffused.

[Second embodiment]

Figure 8:
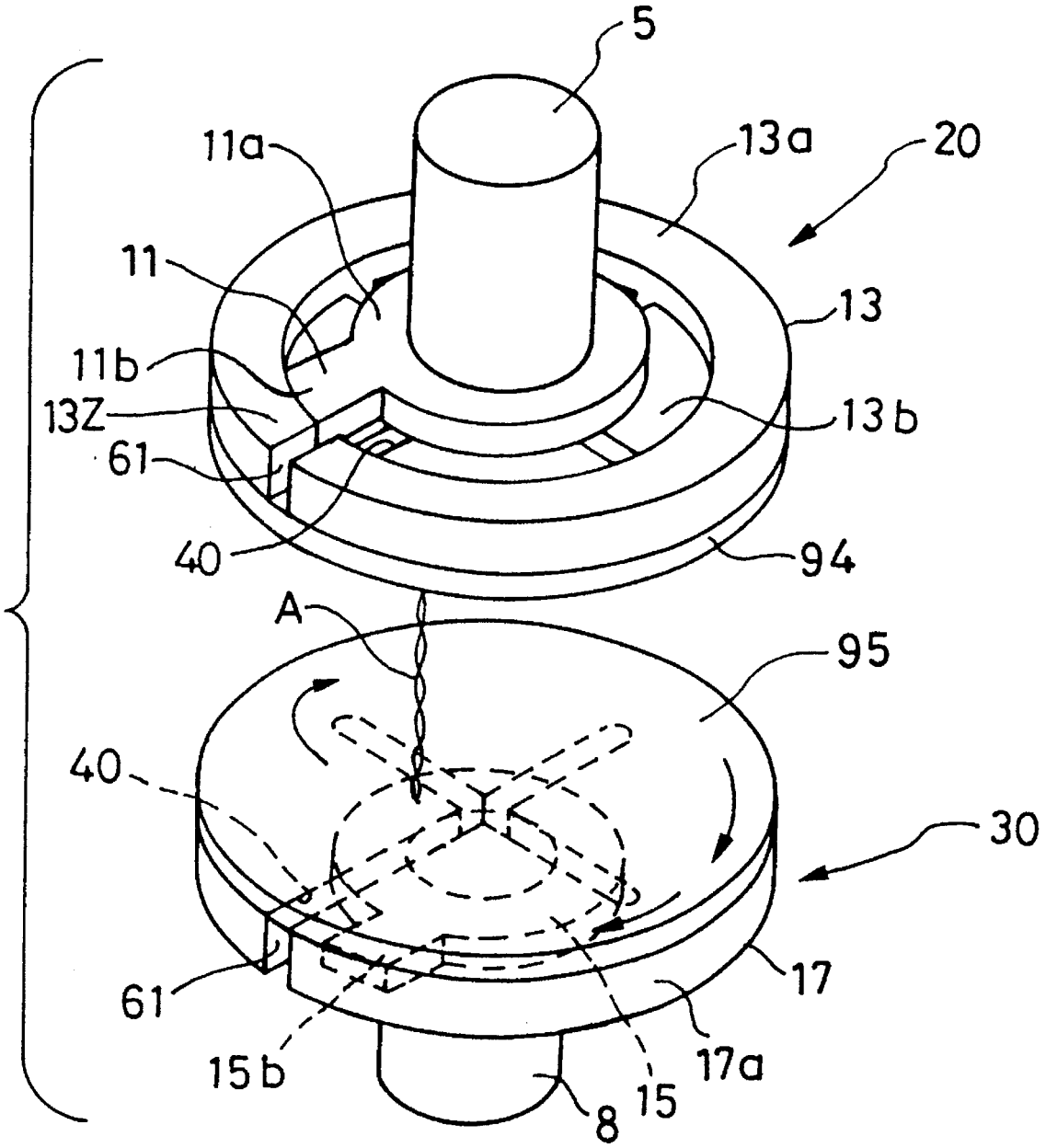
FIG. 8 is a perspective view of electrode assemblies of the vacuum interrupter in a second embodiment in accordance with the present invention.

Hereafter, the second embodiment of the vacuum interrupter corresponding to the constitution of claim 2 is elucidated with reference to FIG. 8.

FIG. 8 is a perspective view of the electrode assembly in the vacuum interrupter of the second embodiment. Referring to FIG. 8, elements having the same structure and function as the elements in the first embodiment are identified by like numerals, and the elucidation is omitted. The vacuum interrupter of the second embodiment shown in FIG. 8 comprises a pair of the stationary electrode assembly 20 and the movable electrode assembly 30 which are identical with each other in configuration and arranged in opposed relationship in the evacuated envelope. The movable electrode assembly 30 is structured so as to connect or disconnect with the stationary electrode assembly 20 in the same manner as the first embodiment.

In the vacuum interrupter of the second embodiment, only configuration which is different from the above-mentioned first embodiment is elucidated hereafter.

Respective main electrodes 94 and 95 of the stationary electrode assembly 20 and the movable electrode assembly 30 in the second embodiment are made of substantially flat disc-shaped metal plates without a slot. The main electrodes 94 and 95 are mounted on the opposing surfaces of the coil electrodes 13 and 17 having a slot. Moreover, edge parts of the opposing surfaces of the disc-shaped main electrodes are formed to curved surfaces, and concentration of an electric field is relaxed between both the main electrodes. The main electrodes 94 and 95 in the second embodiment are made of the same material as the main electrodes in the first embodiment.

A current flow in generation of the electric arc between both the electrode assemblies is elucidated with reference to FIG. 8. When the arc A is generated between the stationary main electrode 94 and the movable main electrode 94, the current flows in the coil parts 13*a* and 17*a* located at the peripheral portion of the respective coil electrodes 18 and 17 having a low resistance. Therefore, the current flows on circular paths of the respective electrode assemblies, and the magnetic field in the axial direction is generated between both the electrodes. The plasma arc generated between both the electrodes is efficiently diffused by the magnetic field. Since the main electrodes 94 and 95 in the second embodiment are flat-shaped and formed to the curved surfaces on the edge parts of the surfaces, the vacuum interrupter having a high withstand voltage is realizable.

[Third embodiment]

Figure 9:
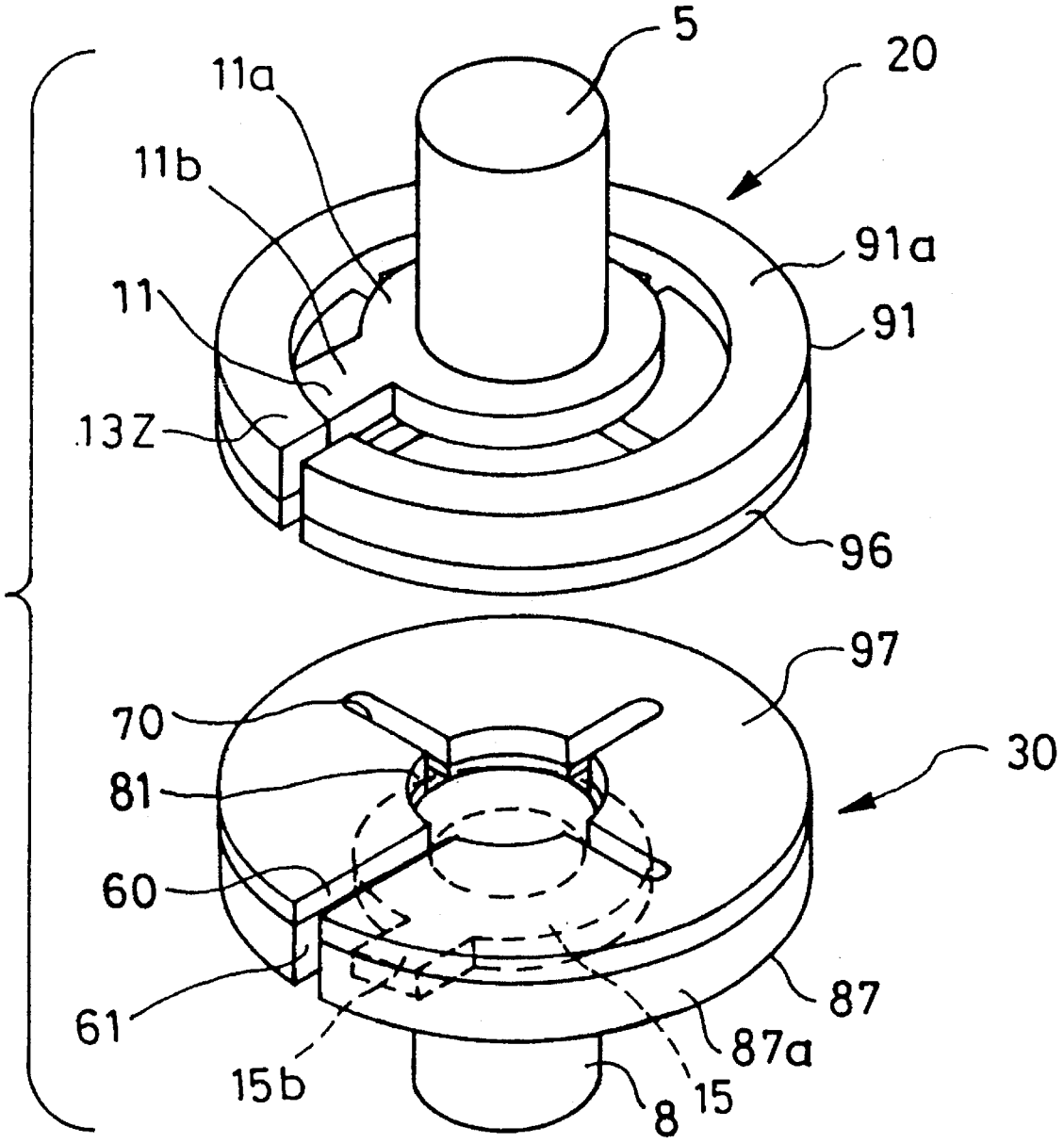
FIG. 9 is a perspective view of the electrode assemblies of the vacuum interrupter in a third embodiment in accordance with the present invention.
Figure 10:
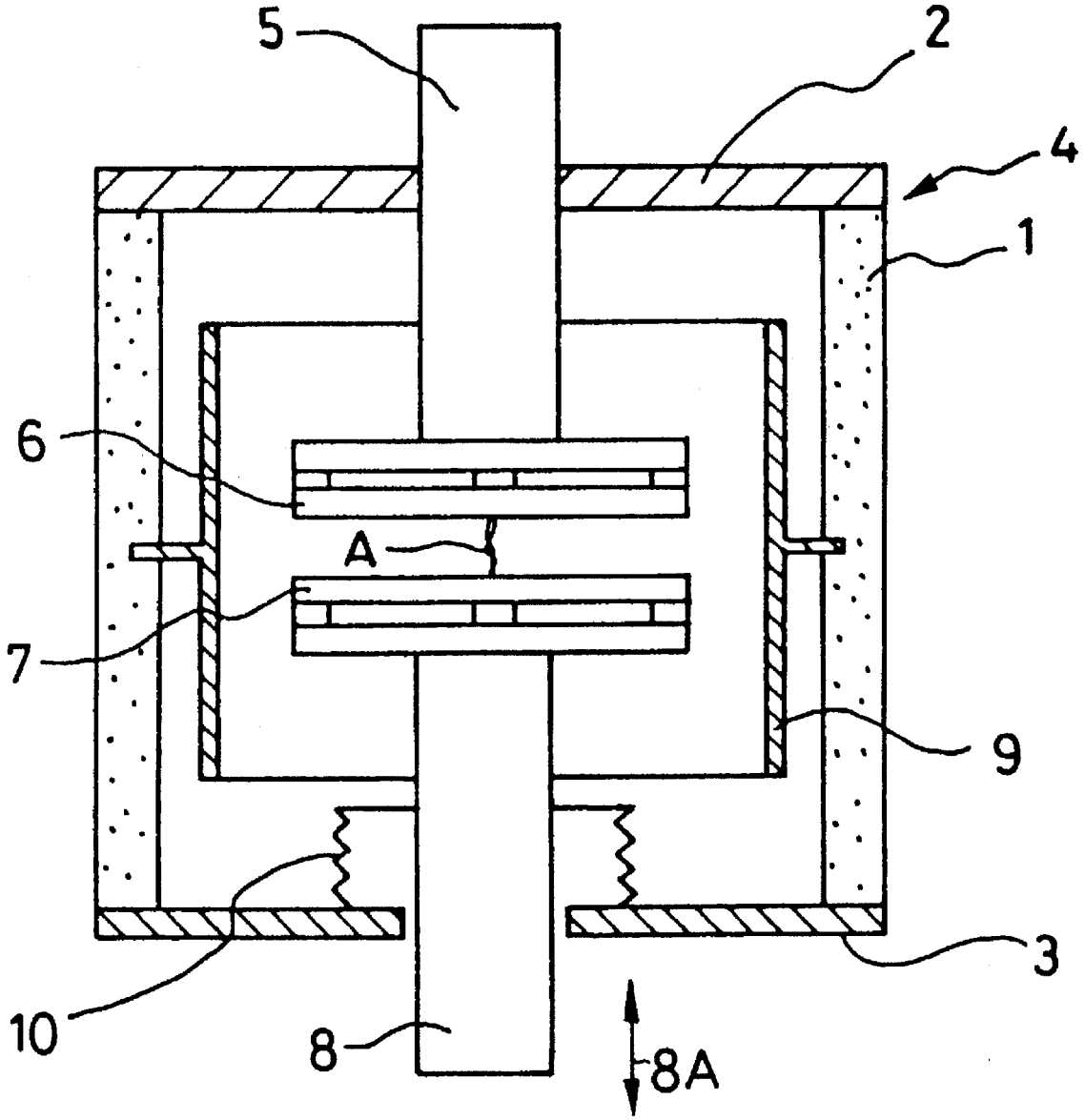
FIG. 10 (Prior Art)
FIG. 10 is the cross-section of the vacuum interrupter of the prior art.
Figure 11:
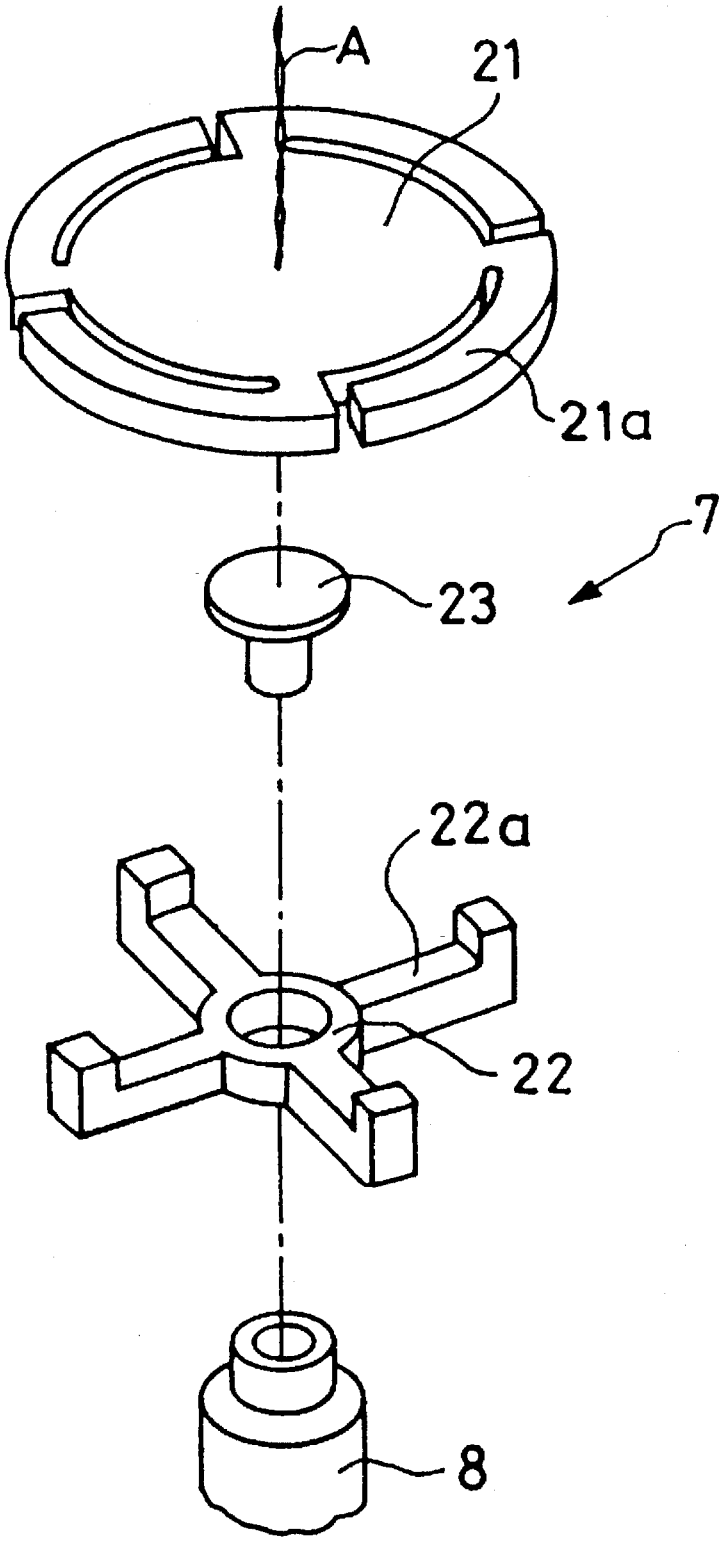
FIG. 11(Prior Art)
FIG. 11 is the exploded perspective assembly view of the movable electrode assembly of the vacuum interrupter of the prior art.
Figure 12:
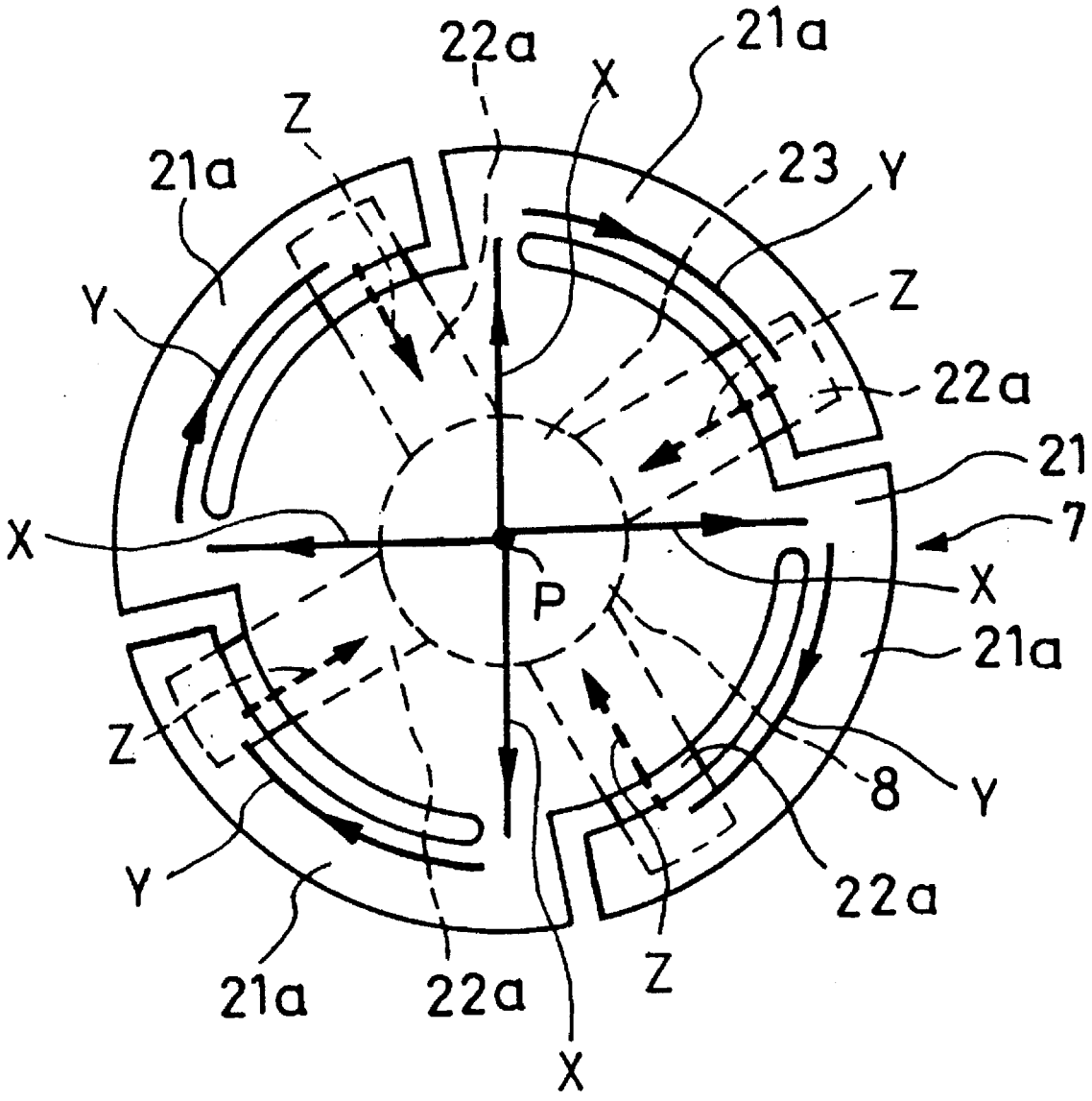
FIG. 12(Prior Art)
FIG. 12 is the plan view of the movable electrode of the vacuum interrupter shown in FIG. 11.

The third embodiment of the vacuum interrupter corresponding to the constitution of claim 3 is elucidated with reference to FIG. 9 hereafter.

FIG. 9 is a perspective view of the electrode assemblies in the vacuum interrupter of the third embodiment. Referring to FIG. 9, elements having the same structure and function as the elements in the first embodiment are identified by like numerals and the description is omitted. The vacuum interrupter in the third embodiment in FIG. 9 comprises a pair of the stationary electrode assembly 20 and the movable electrode assembly 30 which are substantially identical with each other and are arranged in opposed relationship in the evacuated envelope. The movable electrode assembly 30 is structured so as to connect or disconnect with the stationary electrode assembly 20.

In the vacuum interrupter in the third embodiment, only configuration which is different from the first embodiment is elucidated hereafter.

The main electrodes 96 and 97 and the coil electrodes 91 and 87 in the respective electrode assemblies are provided with openings 81 at the central parts of the main electrodes 96 and 97 and the coil electrodes 91 and 87 in addition to the radial slots 60 and 70 passing through the central parts. The diameters of support members (not shown in FIG. 9) for mechanically supporting the main electrodes 96 and 97 and the coil electrodes 91 and 87 are larger than the diameters of the openings 81 in order to close the openings 81. The current flow in generation of the electric arc between both the electrode assemblies in the third embodiment is elucidated hereafter with reference to FIG. 9.

Since the openings 81 are formed at the central part of the main electrodes 96 and 97 and coil electrodes 91 and 87 in the third embodiment, the electric arc is not generated at the central part, but is generated in the vicinity of the circumferential part of the main electrodes 96 and 97. Therefore, the current flows rapidly to the coil parts 91*a* and 87*a* which are disposed on the back face of the circumferential parts of the main electrodes 96 and 97, and the current path becomes substantially circular in the main electrodes 96 and 97. Consequently, a uniform magnetic field in the axial direction is generated between both the electrodes, and the plasma arc is effectively diffused.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A vacuum interrupter comprising:

a first electrode assembly and a second electrode assembly respectively having substantially the same structure arranged in an evacuated envelope in mutually opposed relationship by respective electrode rods in a manner to connect or disconnect with each other; each electrode assembly comprising;

a connecting conductor having a holding part electrically connected to said electrode rod and an arm part extended from said holding part in the radial direction, a coil electrode having a ring-shaped coil part with a cut-part cut out a part of the circumference and electrically connected to said arm part at an end adjacent to said cut-part of said ring-shaped coil part, and a disc-shaped main electrode mounted on a surface of said coil electrode in a manner of facing the other electrode assembly, having at least one slot formed in a radial direction directed to said cut-part of said coil electrode and passing through the central part of a surface of said disc-shaped main electrode opposing to the other electrode assembly, said cut-part of said coil electrode of said first electrode assembly being opposed to said cut-part of said coil electrode of said second electrode assembly, and a position connecting between said coil part and said arm part in said first electrode assembly being arranged in point symmetry with respect to the position connecting between said coil part and said arm part in said second electrode assembly.

2. A vacuum interrupter comprising:

a first electrode assembly and a second electrode assembly having substantially the same structure arranged in an evacuated envelope in opposed relationship by respective electrode rods in order to connect or disconnect with each other, and each electrode assembly comprising;

a connecting conductor having a holding part electrically connected to said electrode rod and an arm part extended from said holding part in the radial direction, a coil electrode comprising a ring-shaped coil part having a cut-part cut out a part of the circumference, and a circular pit having at least one slot in the radial direction communicated to said cut-part and electrically connected to said arm part at an end adjacent to said cut-part of said ring-shaped coil electrode, and a disc-shaped main electrode mounted on a surface of said coil electrode in a manner of facing the other electrode assembly, said cut-part of said coil electrode of said first electrode assembly being opposed to said cut-part of said coil electrode of said second electrode assembly, and a position connecting between said coil part and said arm part in said first electrode assembly being arranged in point symmetry with respect to the position connecting between said coil part and said arm part in said second electrode assembly.

3. A vacuum interrupter in accordance with claim 1, wherein an opening is formed on the central part of said main electrode.

* * * * *